United States Patent [19]

McIlrath

[11] 4,327,785

[45] May 4, 1982

[54] TIE ADZ

[75] Inventor: William P. McIlrath, Racine, Wis.

[73] Assignee: Racine Railroad Products, Inc., Racine, Wis.

[21] Appl. No.: 176,968

[22] Filed: Aug. 11, 1980

[51] Int. Cl.[3] ..... B27C 5/00

[52] U.S. Cl. ..... 144/133 B; 83/928

[58] Field of Search ..... 144/133 R, 133 B; 83/928; 37/104

[56] References Cited

U.S. PATENT DOCUMENTS

| | | | |
|---|---|---|---|
| 1,530,475 | 3/1925 | Billman | 144/133 R |
| 1,537,905 | 5/1925 | Warren | 144/133 R |
| 1,616,505 | 2/1927 | Nelson et al. | 83/928 |
| 1,798,783 | 3/1931 | Buehner et al. | 144/133 R |
| 1,820,636 | 8/1931 | Talboys | 144/133 B |
| 1,830,977 | 11/1931 | Banfer | 144/133 B |
| 2,336,652 | 12/1943 | Talboys | 144/133 B |
| 2,712,841 | 7/1955 | Simmons et al. | 144/133 R |
| 2,754,861 | 7/1956 | Faurel et al. | 144/133 B |
| 2,759,505 | 8/1956 | Abbott | 144/133 B |
| 3,190,324 | 6/1965 | Foxx | 144/133 R |

OTHER PUBLICATIONS

Literature sheet of Railway Track—Work Company, 2381 Philmont Ave., Bethayres, Pa. 19006 (Model E—50 Regauge Adzer).

Literature sheets of L. Geismar, Colmar, France.

*Primary Examiner*—W. D. Bray

*Attorney, Agent, or Firm*—Wegner, McCord, Wood & Dalton

[57] ABSTRACT

A tie adz for cutting a section from a railroad tie adjacent a tie plate, with the tie plate still in association with the tie and preparatory to regauging the rails. The tie adz has a frame with rail-engaging wheels supportable on a rail and with an outrigger extending to the spaced parallel rail. The cutter head is mounted on the frame for pivotal movement about a vertical axis to position the cutter carried thereby at a desired distance from the inner edge of a tie plate and with the location of the cutter head being established by a gauge member. The cutter head is locked in position and has a longitudinally movable driven spindle carrying the cutter which is movable lengthwise of the cutter head to place the cutter at a cutting depth relative to the tie whereby advance of the frame along the rail moves the cutter through the tie and cuts the section from the tie.

8 Claims, 4 Drawing Figures

TIE ADZ

BACKGROUND OF THE INVENTION

This invention pertains to a tie adz for cutting a section from a railroad tie preparatory to regauging the rails by setting a tie plate back to its original position.

Over a period of time, train operation can cause the rails to separate, with one or both of the tie plates on a tie moving outwardly and downwardly into the surface of the tie because of destruction of the upper surface of the tie. This results in a recess in the tie in which the tie plate is located and with the end of the recess adjacent the inner edge of the tie plate having an upwardly-inclined surface back to the upper level of the tie.

Various forms of adzers for railroad ties are known in the art. Such machines typically are constructed of substantial size, requiring substantial power for movement along a rail, and not readily being removable sideways from the rail when required, or have one of several different types of cutters, such as a face mill type cutter, for cutting a substantial area of the upper surface of the tie and without the tie plate being in position.

SUMMARY OF THE INVENTION

A primary feature of the invention disclosed herein is to provide a tie adz for cutting a section from a railroad tie adjacent a tie plate, with the tie plate still in association with the tie preparatory to regauging the rails.

In carrying out the foregoing, the tie adz has a frame with rail-engaging wheels for support on a single rail and with an outrigger to a spaced, parallel rail, and with additional wheels at the side of a frame which can be positioned for removal of the tie adz transversely of the rail by lifting of the outrigger. The frame of the tie adz mounts a cutter head for pivotal movement about a vertical axis to position a cylindrical milling cutter carried by the cutter head at a desired distance from the inner edge of a tie plate with gauge means coacting between the frame and cutter head for setting said position of the cutter and with means for locking the cutter head in said position. The cutter may be advanced lengthwise of the cutter head to a cutting depth relative to the tie whereby advance of the frame along the rail moves the cutter through the tie and cuts the desired section of the tie adjacent the tie plate.

With the foregoing structure, the tie adz may be manually positioned in association with the tie and the cutter then set for the desired cut of a section from the tie, with continued advance of the tie adz along the rail moving the cutter through successive ties for cutting of successive sections.

DESCRIPTION OF THE PREFERRED EMBODIMENT

Figure 1:
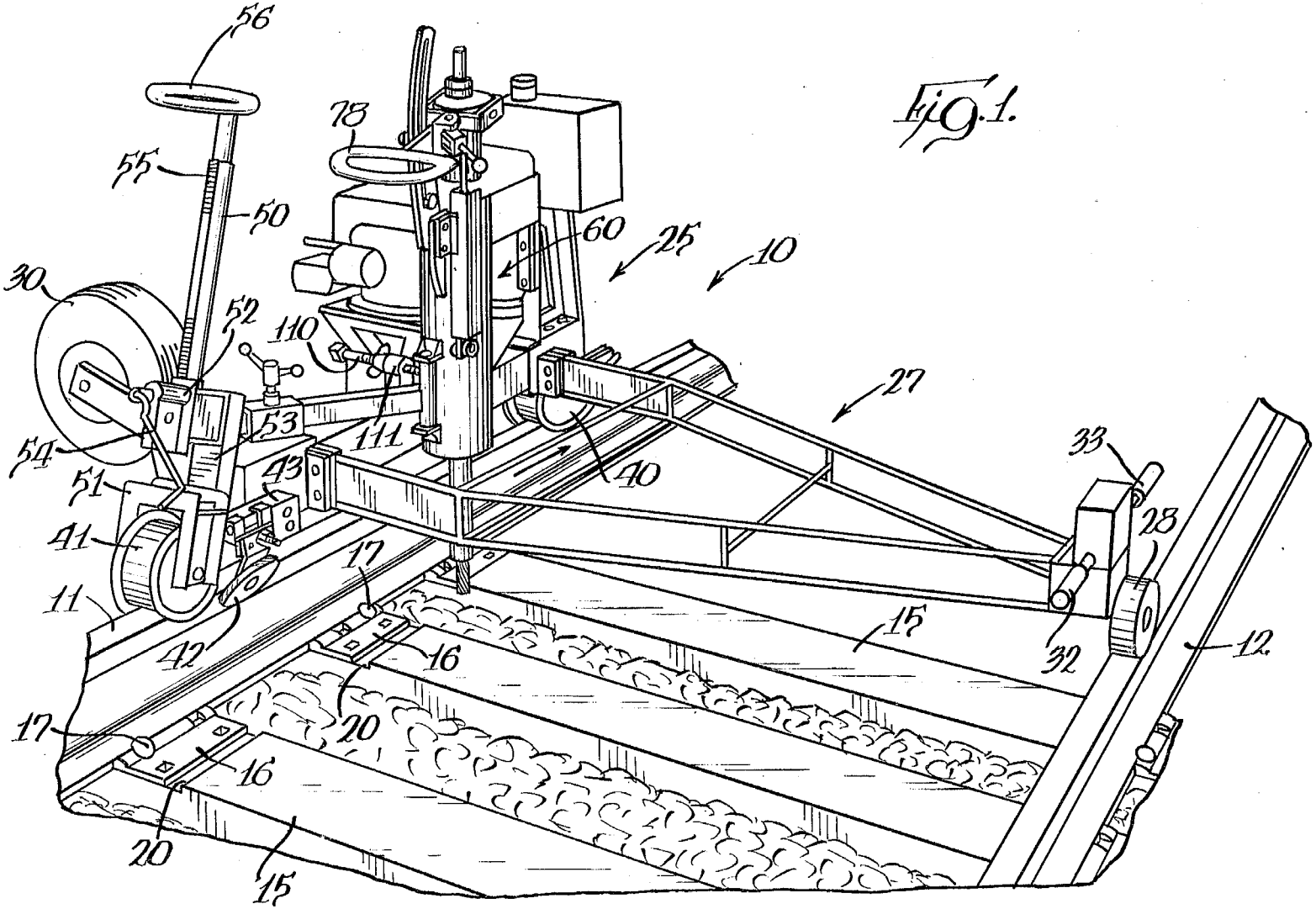
FIG. 1 is a perspective view, looking toward the rear of the tie adz and with the machine shown in association with a pair of rails.

The tie adz is indicated generally at 10 and is shown in FIG. 1 in association with a pair of spaced-apart rails 11 and 12 which are mounted on a series of railroad ties 15 by means of tie plates 16 with rail spikes 17 driven into the tie and holding the base of the rail in association with the tie plate. The tie plates are additionally secured to the ties by attaching means passing through openings in the tie plates and extending into the ties but which have been omitted from the drawings because of the removal thereof as part of the operation of regauging the rails.

After a lengthy period of use, it frequently happens that the spacing between the rails 11 and 12 increases with a shift of the tie plates 16 associated with the respective rails 11 and 12 away from each other to increase the gauge of the track. This normally occurs with some destructive action on the upper surface of the tie underlying the tie plates whereby the tie plates move downwardly as well as outwardly relative to the upper surface of the tie to define a recess and with the end of the recess adjacent the inner edge of the tie plate having an upwardly-inclined surface back to the upper level of the tie. It is the purpose of the tie adz to make a cut in the tie adjacent the tie plate whereby the tie plates at opposite ends of a tie, when free of all connections to the ties, can be moved toward each other and resecured to the tie to reguage the track. The cut made in a pair of the ties 15 is shown in FIG. 1 at 20, which permits subsequent movement of the tie plates 17 toward the right, as viewed in FIG. 1, because of removal of the upwardly-inclined section of the tie which would otherwise preclude a lateral shift of the tie plates during regauging. The cut also provides a continuous flat surface for the tie plate.

Figure 2:
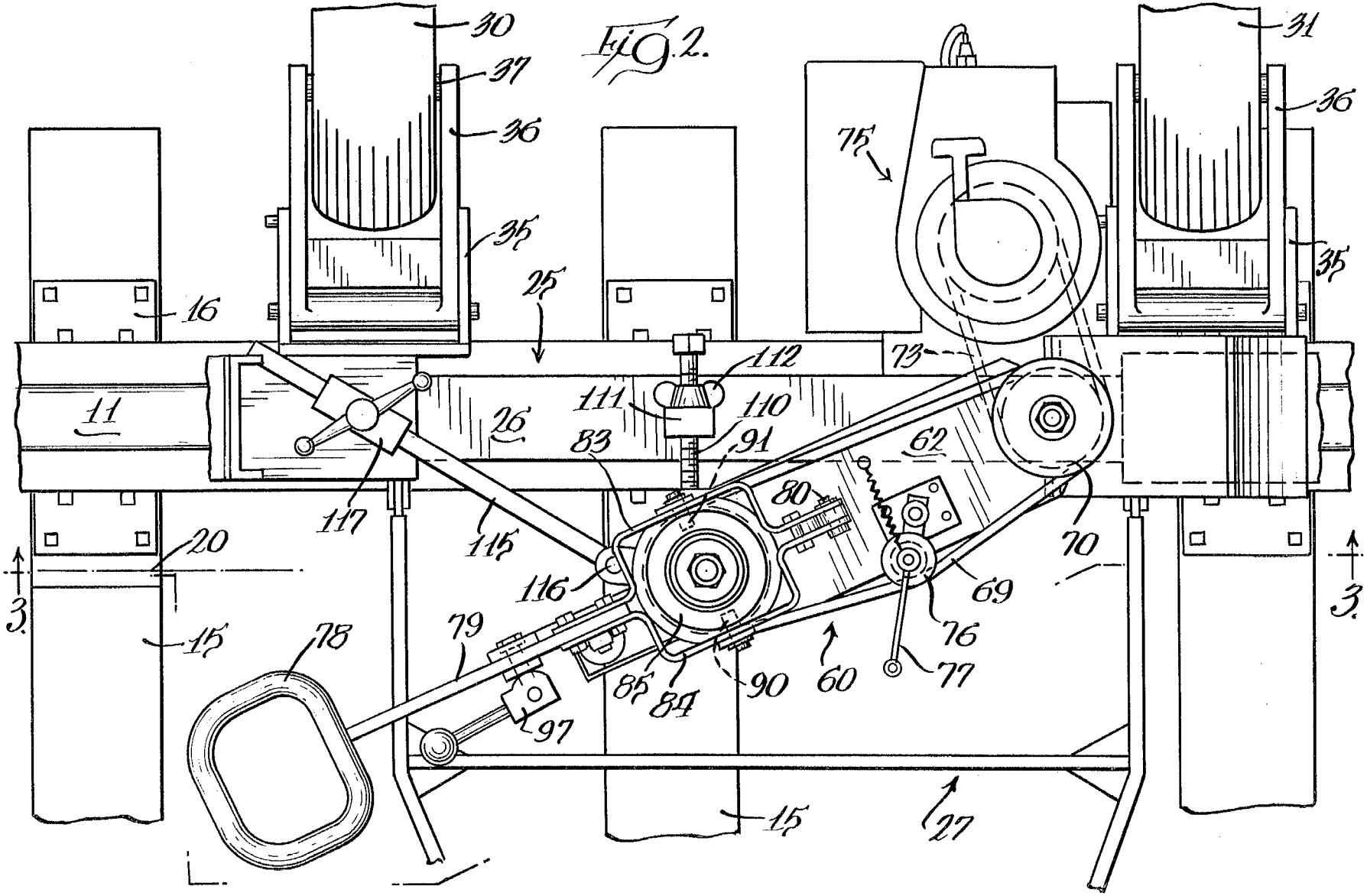
FIG. 2 is a fragmentary plan view of the machine shown in FIG. 1.

The tie adz has a main frame, indicated generally at 25, having a longitudinal beam 26 normally positioned to overlie the rail 11. An outrigger, indicated generally at 27, extends from the main frame 25 and is connected to the beam 26 for mounting of an outboard wheel 28 which rests on the opposite rail 12 to support the tie adz in an upright operative position. The main frame beam 26 has a pair of movably-mounted tires 30 and 31 operatively associated therewith which can be moved from the position shown in FIGS. 1 and 2 to a lowered position whereby the tie adz can be removed laterally from the track by engagement with the handles 32 and 33 at the outboard end of the outrigger frame and lifting the unit onto the tires 30 and 31 for rolling movement away from the track. This action is facilitated by the leverage obtained from the length of the outrigger frame 27. The mounting of each of the tires 30 and 31 is similar, with there being a mounting bracket 35 supported by the frame and a yoke structure 36 pivotally mounted to the mounting bracket and carrying an axle 37 of the tire. The tires can be held in either the retracted or operative positions by means of removable pins fitting with connecting openings in the mounting brackets 35 and yokes 36.

The main frame beam 26 mounts a rail-engaging flanged wheel 40 and with a second section of the frame mounting a second flanged wheel 41 whereby the tie adz is guided for movement along the rails. Lateral movement of the tie adz in a direction from right to left as viewed in FIG. 1 relative to the rail 11 is carefully controlled by a pair of gauge wheels mounted on the frame and with one of the wheels being shown at 42 in engagement with a side of the head of the rail and with there being another gauge wheel located adjacent the rail-engaging wheel 40. The gauge wheels 42 are pivotally mounted on brackets, one of which is shown at 43, and can be retained in either the operative position, shown in FIG. 1, or an elevated, retracted position when not in use and with there being suitable lock structure to hold the gauge wheel 42 in the operative position shown in FIG. 1.

During the use of the tie adz, a cutter is positioned at a desired depth and location for making the cuts 20 in the ties 15 and structure is provided for lifting the cutter relative to the rail and tie structure without changing the adjustment thereof when it is necessary to lift the cutter above filler material disposed between the rails at a crossing. This is accomplished by having the main frame 25 of two sections with the primary part of the frame being that associated with the beam 26. The other section mounts the track-engaging wheel 41. The interconnection between the frame sections is a jack mechanism including a generally vertically-extending rod 50 which extends upwardly from a yoke 51 mounting the rail-engaging wheel 41 and which is surrounded by a tubular housing 52 connected to a bracket 53 extending upwardly from the frame beam 26. The tubular housing 52 rotatably mounts a crank 54 which connects to a gear (not shown) within the tubular housing 52 which meshes with a rack 55 on the vertically-extending rod 50. Rotation of the crank 54 causes the tubular housing 52 to move upwardly along the rod 50 and lift the frame beam 26 and associated structure whereby the cutter carried by the frame is lifted to provide clearance at a crossing. The upper end of the rod 50 mounts a handle 56 engageable by an operator for causing movement of tie adz along the rails by force manually applied to the handle.

The frame 25 has an upstanding structure 58 fixed at one end of the beam 26 at a location generally overlying the track-engaging wheel 40 and which mounts a support structure, indicated generally at 59, which pivotally mounts a cutter head, indicated generally at 60. The cutter head includes a cylindrical cutter sleeve 61 having a pair of vertically-spaced arms 62 and 63 fixed thereto and extending to the support structure 59 and having a pair of collars 64 and 65, respectively, associated with the support structure whereby the cutter head and cutter sleeve can be rotated about a vertical axis for a purpose to be described.

The cutter sleeve 61 rotatably mounts a cutter spindle 66 which, at its lower end, mounts a cylindrical milling-type cutter 67 and which has its upper end extending outwardly beyond the cutter sleeve 61. The cutter spindle is keyed to a driven pulley 68 at the upper end thereof which is driven by means of a drive belt 69 passing around a drive pulley 70 fixed to a shaft 71 rotatably mounted within the pivot mounting structure 59 and extending downwardly therethrough with the lower end exposed for mounting of a driven pulley 72 which is driven by a drive belt 73 extending around a drive pulley 74 of a drive shaft extending downwardly from a power source, such as a gasoline engine, indicated generally at 75. The tension on the belt 69 can be controlled by a pivoted tension pulley 76 operable by a handle 77.

Figure 3:
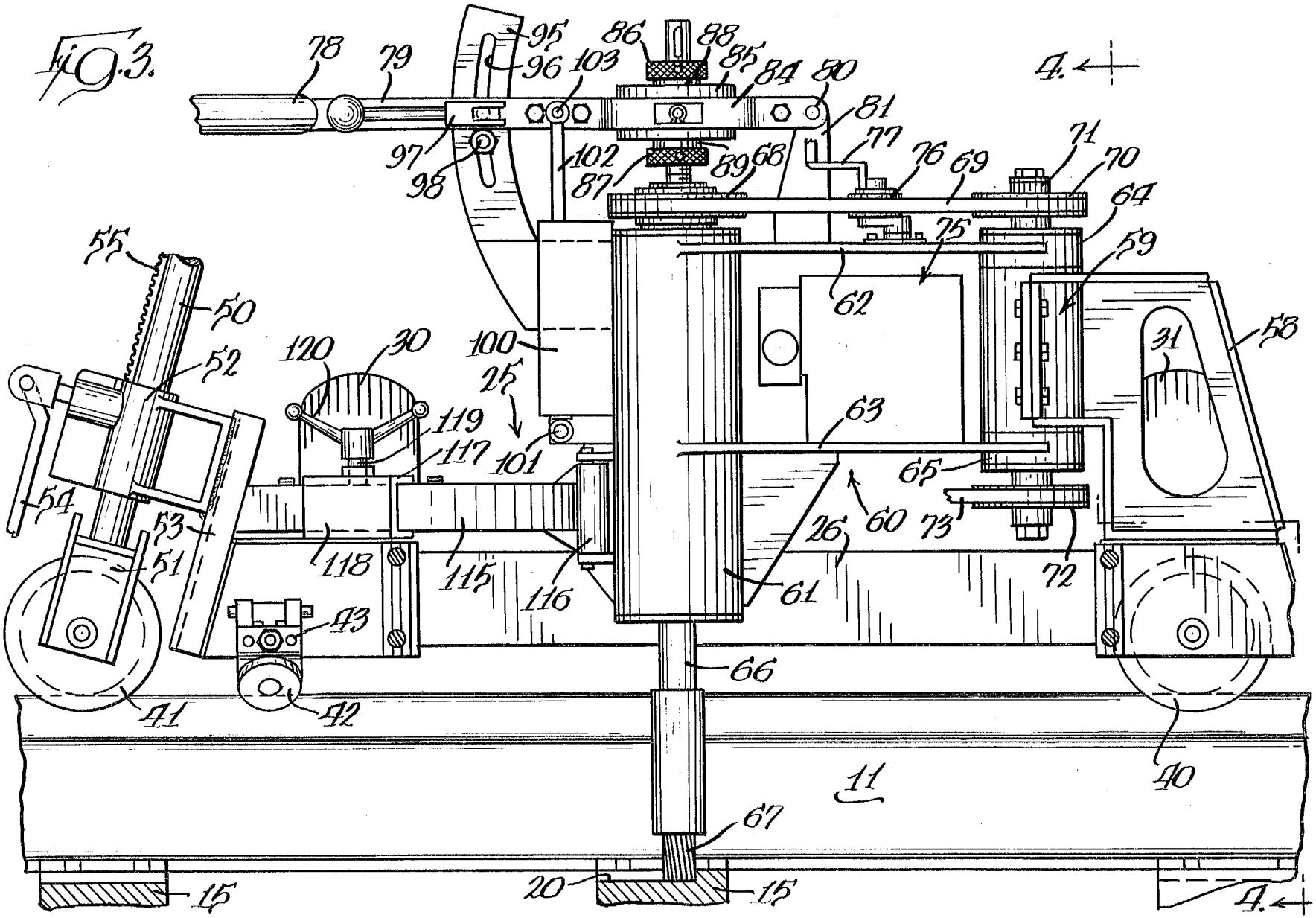
FIG. 3 is a side elevational view of the machine, with parts broken away and taken generally along the line 3—3 in FIG. 2.
Figure 4:
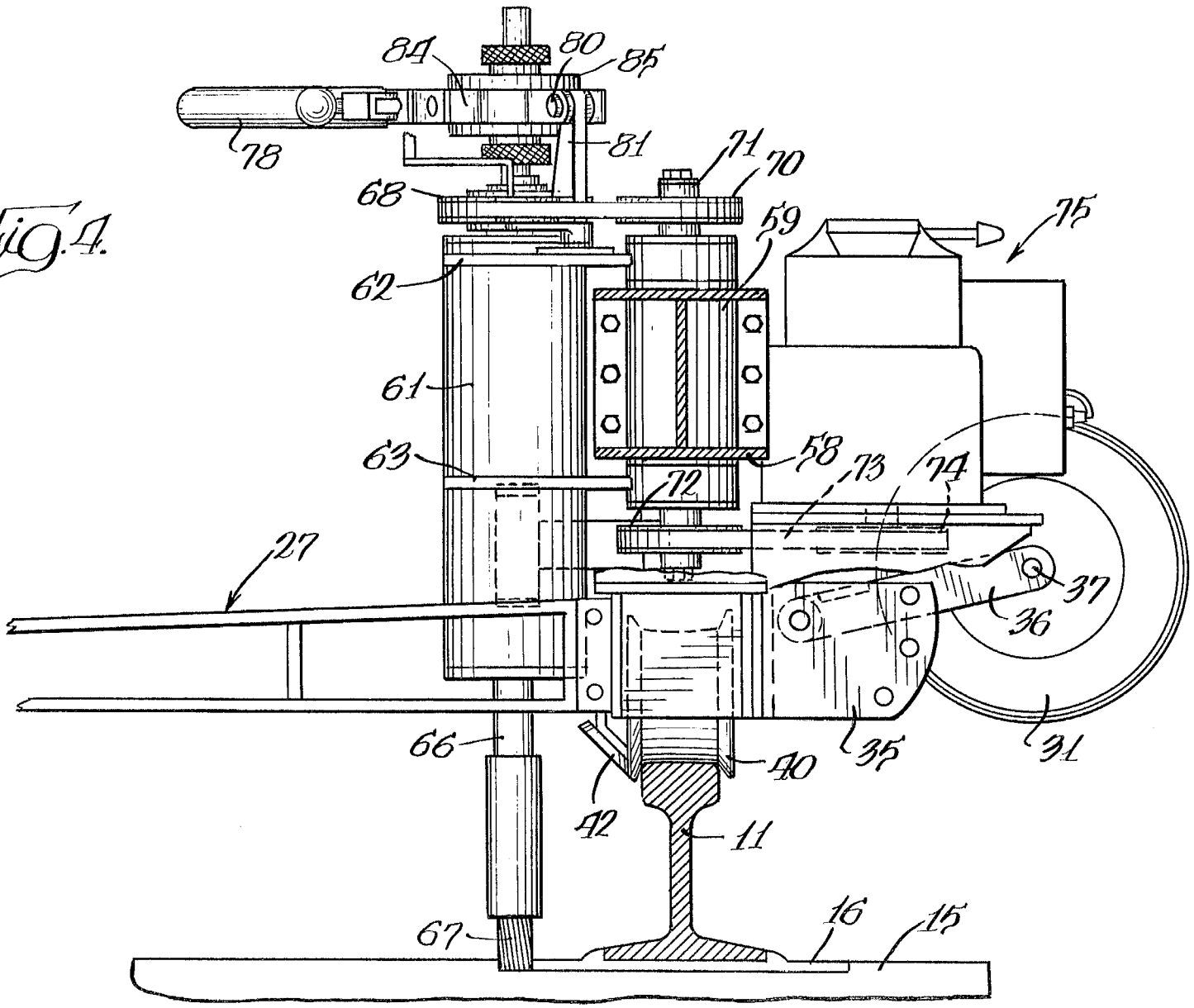
FIG. 4 is a fragmentary, elevational view, looking toward the front of the machine, and generally along the line 4—4 in FIG. 3.

In addition to rotation of the cutter spindle 66, it is mounted for longitudinal movement relative to the cutter sleeve 61 for positioning the cutter 67 at a cutting depth, as shown in FIGS. 3 and 4. For this purpose, the spindle 66 is longitudinally movable within structure mounted within the sleeve 61 whereby the spindle can move longitudinally while still being powered for rotation through the key connection to the driven pulley 68. The vertical movement of the spindle 66 is under the control of a handle 78 affixed to the end of an arm 79 which is pivotally mounted by a pivot pin 80 at one end thereof to a bracket 81 extending upwardly from the sleeve mounting arm 62. Intermediate its ends the arm 79 is formed with a pair of spaced-apart lengths 83 and 84 (FIG. 2) which span a cylindrical member 85 positioned on the upper end of the cutter spindle 66 and which is rotatable relative thereto but held in position lengthwise thereof by a pair of stop members 86 and 87 which are secured to the cutter spindle 66 and which are spaced from the member 85 by a pair of bearing collars 88 and 89. The arm lengths 83 and 84 interfit with the member 85 by a pair of pins 90 and 91 which extend into a groove on the exterior of the member 85 whereby the pins can move relative to the groove as the arm 79 is raised and lowered to cause raising and lowering movement of the cutter spindle 66. An upwardly-extending slotted arm 95 extends upwardly from the cutter sleeve 61 and has a slot 96 receiving a manually operable lock structure 97 carried by the arm 79 which can be placed in a lock position to hold the cutter spindle 66 at a desired lengthwise position, such as shown in FIG. 3. The position can be preset by an adjustable stop 98 which can be moved along the slot 96 and tightened to determine a lower limit position for the arm 79. The weight of the cutter spindle 66 and the arm 79 and associated structure can be counterbalanced by a counterbalance cylinder located within a housing 100 affixed to the cutter sleeve 61. A lower end of the counterbalance cylinder is pivoted at 101 to a bracket affixed to the cutter sleeve and the cylinder has an upwardly-extending rod 102 which pivotally connects to the arm 79 at 103. With this structure, the handle 78 can be operated easily to raise and lower the cutter and with the depth of the cutter being pre-established by location of the adjustable member 98 and the cutter held in position by operation of the lock 97.

In operation of the tie adz, it is important that the cutter not make contact with the tie plate. Part of the accuracy of the position is in the location of the main frame on the rails by use of the gauge wheels 42 which engage the side of the rail head. Additionally, gauge means accurately locate the cutter head and, therefore, the cutter relative to the rail and tie plate. The gauge means includes threaded member 110 which is rotatably mounted within a threaded member 111 fixed to and extending upwardly from the main frame beam 26. An end of the threaded member abuts the cutter sleeve 61 to set a location for the cutter head whereby the cutter head and cutter cannot move to a position closer to the rail 11 and within this position being maintained by a wing nut 112 which holds the threaded member 110 in adjusted position.

Means for locking the cutter head in the gauge position includes a bar 115 pivoted to the cutter sleeve 61 at 116 which is longitudinally movable relative to a bar-clamping member 117. The bar-clamping member is in the form of a tubular member 118 shaped to receive the bar 115 within the interior thereof and with the sleeve 118 having a threaded member 119 with a handle 120 at the upper end thereof whereby the threaded member can be moved between advanced and retracted positions and when in the advanced position engages against the bar 115 to lock the bar relative to the clamping member and maintain the cutter head in the selected position.

With the structure disclosed herein, the tie adz can be posititioned on a pair of rails, as shown in FIG. 1, and then the cutter head positioned to the proper location for cutting the groove 20 in the tie relative to a distance from the tie plate by setting of the gauge means including the threaded member 110 and then locking the cutter head in position by operation of the bar-clamping member 117. Prior to this, the gauge wheels 42 have been lowered into position against a side of the rail head. After setting the distance of the cutter from the rail and tie plates, the handle 78 can be operated to lower the cutter to the desired depth for cutting the groove 20 in the tie and with this position maintained by operation of the lock 97. With the cutter rotating, the tie adz can then be manually moved along the rail by engagement with the handle 56 and the cutter 67 cuts the groove 20 in successive ties as the tie adz is moved along the rails. The tie adz can be moved across a crossing without any change in the adjustments by operation of the jack mechanism and, particularly, by rotation of the crank 54 to lift the cutter 67 to a clearance position and, after the tie adz has moved through the crossing, the frame can be lowered to bring the cutter back to operative position.

I claim:

1. A tie adz for cutting a section from a railroad tie adjacent a tie plate with the tie plate still in association with the tie preparatory to regauging the rails comprising, a frame with rail-engaging wheels supportable on one of parallel spaced rails, an outrigger on the frame and extending to the other rail, a cutter head mounted on said frame for pivotal movement about a vertical axis to position a cylindrical milling cutter carried thereby at a desired distance from the inner edge of a tie plate, gauge means coacting between said frame and cutter head for setting said position of the cutter, means for locking the cutter head in said position, and means for advancing the cutter lengthwise of the cutter head to a cutting depth relative to the tie whereby advance of the frame along the rail moves the cutter through the tie and cuts said section.

2. A tie adz as defined in claim 1 wherein said frame is of two sections with a rail-engaging wheel on each section, and jack mechanism interconnecting said sections whereby operation of said jack can lift one section of the frame and said cutter head being on said one part of the frame for elevation of the cutter to a clearance position when said one part is lifted.

3. A tie adz as defined in claim 1 including a pair of ground-engaging wheels movably mounted on said frame at a side thereof opposite said outrigger and positionable in engagement with the ground to facilitate sideways removal of the tie adz from a rail.

4. A tie adz as defined in claim 1 wherein said cutter advancing means includes an arm pivoted to said frame and operatively connected to a longitudinally-movable spindle for the cutter, and means for clamping said arm in a predetermined position.

5. A tie adz as defined in claim 4 including adjustable means for limiting the pivotal movement of said arm to set the cutting depth of the cutter, and counterbalance means connected to said arm.

6. A tie adz as defined in claim 1 including movably-mounted gauge wheels positionable to engage the first-mentioned rail.

7. A tie adz for cutting a section from a railroad tie adjacent a tie plate with the tie plate still in association with the tie preparatory to regauging the rails comprising, a two-section frame with a rail-engaging wheel on each section supportable on a rail and an outrigger connected to the frame and extending to the spaced parallel rail, a cutter head mounted on one frame section for pivotal movement about a vertical axis to position a cutter carried thereby at a desired distance from the inner edge of a tie plate, means coacting between said frame and cutter head for holding said cutter head in a selected position, means for positioning the cutter at a cutting depth relative to the tie, and jack mechanism interconnecting the two sections of the frame and operable to lift said one frame section relative to the other frame section whereby the cutter is lifted to provide clearance during movement of the frame along the rails.

8. A tie adz for cutting a section from a railroad tie adjacent a tie plate with the tie plate still in association with the tie comprising, a frame with rail-engaging wheels supportable on a rail and, said frame having an outrigger extending to the spaced parallel rail, a cutter head mounted on said frame for pivotal movement about a vertical axis to position a cutter carried thereby at a desired distance from the inner edge of a tie plate, gauge means including an adjustable member mounted on said frame and engageable with said cutter head for setting said position of the cutter, means for locking the cutter head in said position including a bar pivoted on said cutter head and movable relative to a bar clamping member mounted on said frame, means for advancing the cutter lengthwise of the cutter head to a cutting depth relative to the tie including an arm pivoted to said frame and operatively connected to said cutter.

* * * * *